US009903374B2

(12) United States Patent
Kosamana et al.

(10) Patent No.: US 9,903,374 B2
(45) Date of Patent: Feb. 27, 2018

(54) MULTISTAGE COMPRESSOR AND METHOD FOR OPERATING A MULTISTAGE COMPRESSOR

(71) Applicant: Nuovo Pignone Srl, Florence (IT)

(72) Inventors: Bhaskara Kosamana, Bangalore (IN); Manuele Bigi, Florence (IT); Kalyankumar V, Bangalore (IN); Lakshmanudu Kurva, Bangalore (IN); Massimiliano Borghetti, Florence (IT); Marco Formichini, Florence (IT)

(73) Assignee: Nuovo Pignone Srl, Florence (IT)

( * ) Notice: Subject to any disclaimer, the term of this patent is extended or adjusted under 35 U.S.C. 154(b) by 155 days.

(21) Appl. No.: 14/653,940

(22) PCT Filed: Dec. 16, 2013

(86) PCT No.: PCT/EP2013/076732
§ 371 (c)(1),
(2) Date: Jun. 19, 2015

(87) PCT Pub. No.: WO2014/095742
PCT Pub. Date: Jun. 26, 2014

(65) Prior Publication Data

US 2015/0316064 A1 Nov. 5, 2015

(30) Foreign Application Priority Data

Dec. 21, 2012 (IT) ..... FI2012A0290

(51) Int. Cl.
*F04D 29/58* (2006.01)
*F04D 17/12* (2006.01)
(Continued)

(52) U.S. Cl.
CPC ..... *F04D 17/122* (2013.01); *F04D 17/125* (2013.01); *F04D 29/054* (2013.01);
(Continued)

(58) Field of Classification Search
CPC ..... F04D 17/12; F04D 17/122; F04D 29/054; F04D 29/584; F04D 29/624; F04D 29/588
See application file for complete search history.

(56) References Cited

U.S. PATENT DOCUMENTS 4,200,784 A 4/1980 Albaric et al.
5,591,016 A * 1/1997 Kubota ..... F04D 29/061 415/104

(Continued)

FOREIGN PATENT DOCUMENTS

CN 201330749 Y 10/2009
CN 101644269 A 2/2010

(Continued)

OTHER PUBLICATIONS

Unofficial English Translation of Chinese Office Action issued in connection with corresponding CN Application No. 01380073644.7 dated Aug. 29, 2016.

(Continued)

*Primary Examiner* — Marina Tietjen
*Assistant Examiner* — Paul J Gray
(74) *Attorney, Agent, or Firm* — GE Global Patent Operation

(57) ABSTRACT

A multi-stage compressor is described, comprising a rotor having a plurality of axially stacked impellers and a tie rod extending through the stacked impellers and holding the impellers together. A gas compression path extends from a compressor inlet to a compressor outlet and through the impellers. A flow channel is provided between the tie rod and the stacked impellers. The flow channel develops along at least a portion of the tie rod. Hot gas is diverted from the compression path and flows through the flow channel to heat the tie rod during startup of the compressor.

20 Claims, 7 Drawing Sheets

(51) Int. Cl.
*F04D 29/62* (2006.01)
*F04D 29/054* (2006.01)

(52) U.S. Cl.
CPC ..... *F04D 29/584* (2013.01); *F04D 29/624* (2013.01); *F04D 29/588* (2013.01)

(56) References Cited

U.S. PATENT DOCUMENTS

| | | | | |
|---|---|---|---|---|
| 2009/0044548 | A1 | 2/2009 | Masoudipour et al. | |
| 2009/0162190 | A1 | 6/2009 | Romani et al. | |
| 2010/0124491 | A1* | 5/2010 | Bosen ..... | F04D 17/122 415/198.1 |
| 2011/0008186 | A1 | 1/2011 | Palomba et al. | |
| 2011/0262284 | A1 | 10/2011 | Guernard | |
| 2011/0280742 | A1 | 11/2011 | Guenard | |

FOREIGN PATENT DOCUMENTS

| | | | |
|---|---|---|---|
| CN | 101956712 | A | 1/2011 |
| JP | 2005330878 | A | 12/2005 |

OTHER PUBLICATIONS

International Search Report and Written Opinion dated Feb. 20, 2014 which was issued in connection with PCT Patent Application No. PCT/EP2013/076732 which was filed on Dec. 16, 2013.
IT Search Report dated Sep. 6, 2013 which was issued in connection with IT Patent Application No. FI2012A000290 which was filed on Dec. 21, 2012.

* cited by examiner

STATE OF THE ART

STATE OF THE ART

MULTISTAGE COMPRESSOR AND METHOD FOR OPERATING A MULTISTAGE COMPRESSOR

BACKGROUND

Embodiments of the subject matter disclosed herein generally relate to multi-stage compressors and methods for operating the same. More specifically, the disclosure relates to multistage compressors having a stack rotor configuration.

Multi-stage compressors are widely used for industrial refrigeration, oil and gas processing and in low temperature processes and other uses.

Among the multitude of multi stage compressors of the know type, multi-stage compressors comprising stacked impellers held together by a tie rod are well known. A multistage compressor comprising a stack rotor is disclosed e.g. in US2011/0262284.

FIG. 1 illustrates an axial sectional view of a multi-stage compressor of the current art, and FIG. 2 illustrates an enlargement of a detail of FIG. 1. Said compressor is labeled 100 and comprises an inlet 110A, an outlet 110B, a rotor 111 comprised of a plurality of stacked impellers 112, and a stationary housing 113 housing the rotor 111. The stationary housing comprises a diaphragm 113A wherein each impeller discharges its gas flow to convert the kinetic energy of the gas flow into pressure recovery before returning the gas flow to the next impeller. Each impeller/diaphragm combination is usually referred to as a "stage". The diaphragm 113A and the rotor 111 are housed in a casing 113B. In the compressor, a gas compression path P (indicated by a dashed line) extending from the compressor inlet 110A to the compressor outlet 110B and through said plurality of impellers 112 and the diaphragm 113A is defined. The compression path P is sealed against the casing, diaphragm and rotor, using suitable seals, e.g. dry gas seals S.

The impellers 112 are held together by a tie rod 114, extending axially through the impellers 112. The first compressor stage comprises a first impeller 112A, while the last compressor stage comprises the last impeller 112B. The rotor 111 comprises also two terminal elements 115A and 115B provided at the two opposite ends of the plurality of impellers 112. The two ends of the tie rod 114 are constrained to the terminal elements 115A-115B.

More in particular, the hubs of the impellers 112 have through holes 116 wherein the tie rod 114 is made to pass. The holes 116 are dimensioned so as to leave a clearance 117 between the tie-rod 114 and the impellers 112.

With particular reference to FIG. 2, each impeller 112 comprises two opposite toothed flanges 118 meshing with respective toothed flanges of two respective adjacent impellers 112 or, in the case the impeller is the first or the last impeller of the impellers stack, respectively with a toothed flange of an adjacent impeller 112 and the toothed flange 119 of one of the terminal elements 115A, 115B.

To avoid gas leakage from the compression path P to the clearance 117, seals 120 on the meshing areas 121 of the teeth are provided.

The gas compressor comprises a balancing line 122 (indicated by a dash-dot line) for balancing the axial thrust of the impellers on the rotor bearings. More in particular, the compressor comprises a balancing drum 123 formed on the terminal element 115B. The balancing drum 123 separates a balancing zone 124 from a zone in fluid communication with the outlet of the last compressor stage. The balancing zone 124 is fluidly connected with the inlet of the first impeller 112A, such that the pressure in the balancing zone 124 is substantially equal to the pressure at the inlet of the first impeller 112A. The balancing drum 123 is arranged in a cylindrical housing formed in the compressor casing. Between the housing and the drum a labyrinth seal 123A is provided, so that a calibrate gas flow leakage F from the last stage towards the balancing zone 124 is allowed. The pressure difference between said balancing zone 124 and the opposite face of the balancing drum facing the last stage impeller 112B generates an axial thrust against the balancing drum. The axial thrust on the balancing drum 123 counterbalances the axial thrust generated on the impellers by the process fluid flowing through the compressor. The balancing line 122 is formed by a pipeline, which is usually external to the casing of the compressor.

The compression process provokes a temperature increase of the processed gas flowing through the compressor. During startup, machine components are usually at ambient temperature and are heated up by the processed gas until a steady temperature condition is achieved. In the compressors having a stack rotor as described with reference to FIGS. 1 and 2, the impellers heat faster than the tie rod. This leads to high temperature gradients between the tie rod 114 and the impellers 112 during the startup transient phase. Due to this high temperature gradient, high thermal stresses are generated, which can shorten the life of the compressor or provoke malfunctioning.

SUMMARY OF THE INVENTION

To at least partly alleviate one or more of the problems of the prior art, a multi-stage compressor is provided, wherein heat developed by compressing the fluid processed by the compressor is used to heat the tie rod, which holds the stacked impellers of the compressor rotor. The multi-stage compressor comprises a return flow path, along which a fraction of the compressed process gas flows back from a downstream location to an upstream location of the gas compression path. The return flow path flows along the tie rod, so that heat generated by compression in the compressed or partly compressed processed gas is transferred to the tie-rod by forced convection. The tie rod is thus heated faster than in current art compressors.

According to some embodiments, a multi-stage compressor is provided, comprising a compressor rotor comprised of a plurality of axially stacked impellers, a tie rod extending through the stacked impellers and holding the impellers together and a gas compression path extending from a compressor inlet to a compressor outlet and through the plurality of impellers. The compressor further comprises a flow channel between the tie rod and the stacked impellers. The flow channel extends along at least a portion of the tie rod. The flow channel is in fluid communication with a first location and a second location along the gas compression path. During normal operating conditions, the pressure of the gas processed by the compressor at said first location is different than the pressure of the gas at the second location. The gas pressure difference between the first location and the second location in the compression path generates a gas flow along the flow channel.

At compressor startup, the temperature of the gas flowing from the first location to the second location is generally higher than the temperature of the tie rod, due to the temperature increase of the gas caused by compression. The gas flowing along the flow channel heats the tie rod, thus reducing the temperature gradient between the impellers and the tie rod.

According some embodiments, the flow channel can be used as a "balancing line" for balancing the thrust of the impellers on the bearings, as better described below.

In some exemplary embodiments, the first location is provided at the first compressor stage, and the second location is provided at the last compressor stage. In this way, the thermal benefits on the tie rod are maximized, since the hot gas flow contacts the tie rod along almost the entire axial extension thereof. Moreover, the compressed gas contacting the tie rod is taken from the last stage, i.e. where the gas temperature is the highest.

According to exemplary embodiments, each impeller comprises two opposite contacting surfaces for contacting the surfaces of two other adjacent impellers, or the surface of an adjacent impeller and the surface of a terminal element at one end of the plurality of stacked impellers. If the gas compressor comprises a first passage and a second passage, at least one of said passages is defined between the contacting surfaces of two adjacent impellers or between the contacting surfaces of one of said terminal elements and of an adjacent impeller. This configuration simplifies the construction of the compressor. In some exemplary embodiments, the first passage can be formed between mutually contacting and meshing surfaces of the hub of the first impeller and a corresponding meshing surface of the first terminal element. The second passage can be formed between mutually contacting and meshing surfaces of the hub of the last impeller and a corresponding meshing surface of the second terminal element.

To provide torsional constraint between the mutually stacked impellers and first and second terminal elements, torsional constraining members can be provided. In some embodiments, the contacting surfaces are provided with front toothed flanges forming the respectively meshing surfaces. The teeth of the mutually co-acting flanges form a Hirth coupling. Other connecting members can be used instead, such as curvic connections, bolts or other known mechanisms.

To prevent gas from flowing across meshing surfaces where no gas flow is required, e.g. at the intermediate contacting and meshing surfaces between adjacent impellers, sealing members can be provided around the meshing areas. For instance, the sealing members can be annular seals arranged on the inner surface of the through holes on the impeller hubs, wherein the tie rod is arranged, just at the meshing area.

According to other embodiments, at least one of the two passages can be a duct, e.g. provided, through the hub of an impeller or of a terminal element.

In some embodiments, the gas compressor comprises a balancing line for balancing the axial thrust of the impellers on the rotor bearing. More in particular, the compressor comprises a balance drum axially constrained to the impellers and contrasting the axial thrust of the impellers. The drum has a first face facing the last compressor stage and a second opposite face facing a balancing zone fluidly connected with the inlet of the first compressor stage, so that the pressure in the balancing zone is substantially equal to the pressure at the inlet of the first compressor stage. The pressure difference on the two faces of the balancing drum generates an axial thrust opposing the axial thrust generated on the impellers by the gas being processed through the compressor. The compressor comprises a pathway fluidly connecting the outlet of the last stage with the balancing zone associated to the balance drum. In some embodiments at least a passage fluidly connecting the flow channel and the balancing zone is provided. In this configuration, the flow channel formed between the impellers and the tie rod can function as a "balancing line". An external balancing line is thus not required.

According to some embodiments, the passage fluidly connecting the flow channel and the balancing zone is provided through the balance drum.

According to a further aspect, the disclosure relates to a method for operating a multi-stage compressor, comprising a compressor rotor with a plurality of axially stacked impellers held together by a tie rod, and a flow channel extending along at least a portion of the tie rod. The method comprises the step of heating the tie rod by flowing compressed hot gas, e.g. drawn from the gas compression path, along the flow channel through the impellers and along the tie rod. The compressed hot gas flows from a downstream stage to an upstream stage of the compressor.

In some exemplary embodiments, the method provides for heating the tie rod by means of a flow of compressed gas flowing from the outlet of the last impeller to the inlet of the first impeller.

Features and embodiments are disclosed here below and are further set forth in the appended claims, which form an integral part of the present description. The above brief description sets forth features of the various embodiments of the present disclosure in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS OF THE INVENTION

Figure 1:
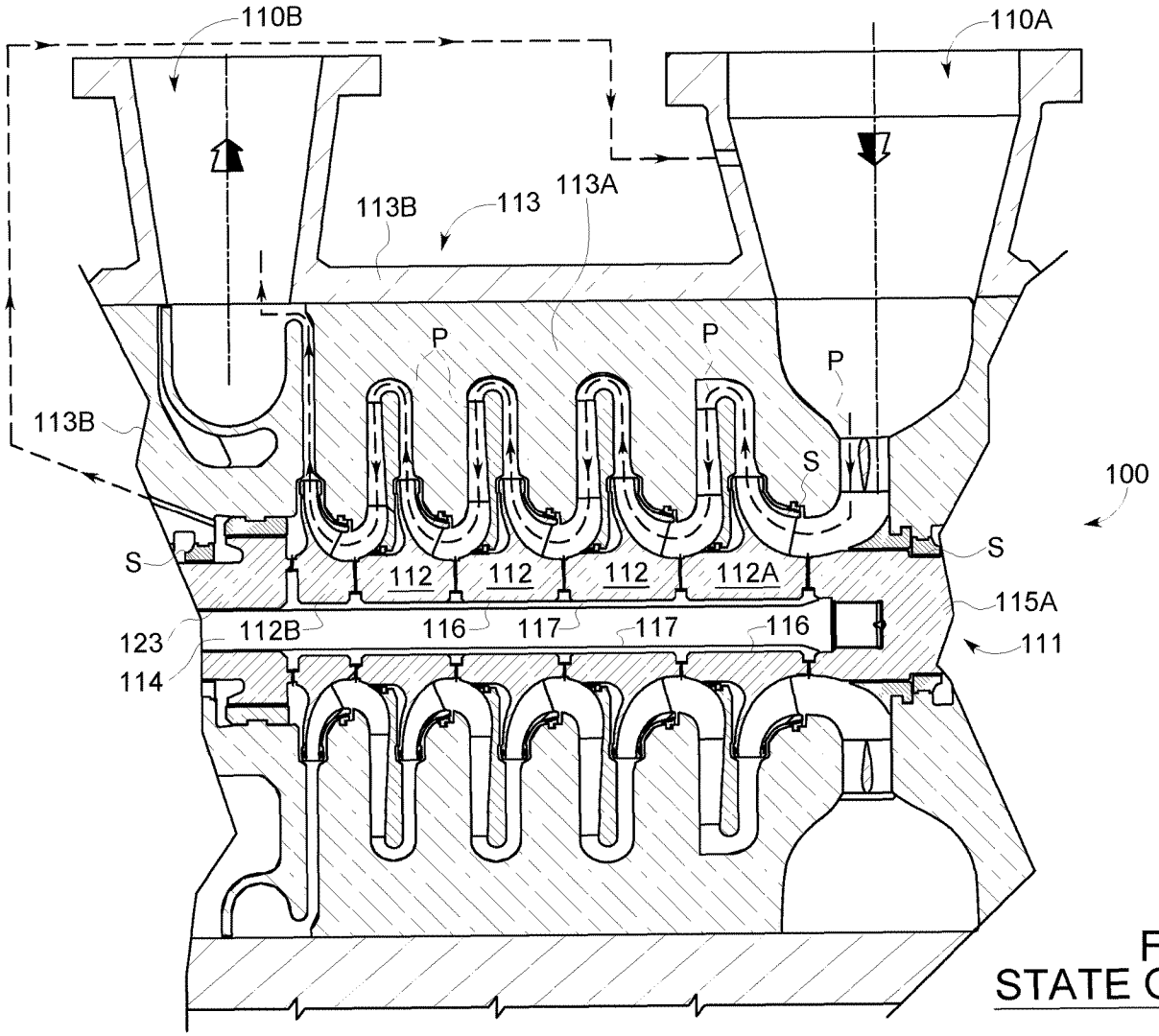
FIG. 1 illustrates an axial-sectional view of the main part of a multi-stage compressor of the prior art.
Figure 2:
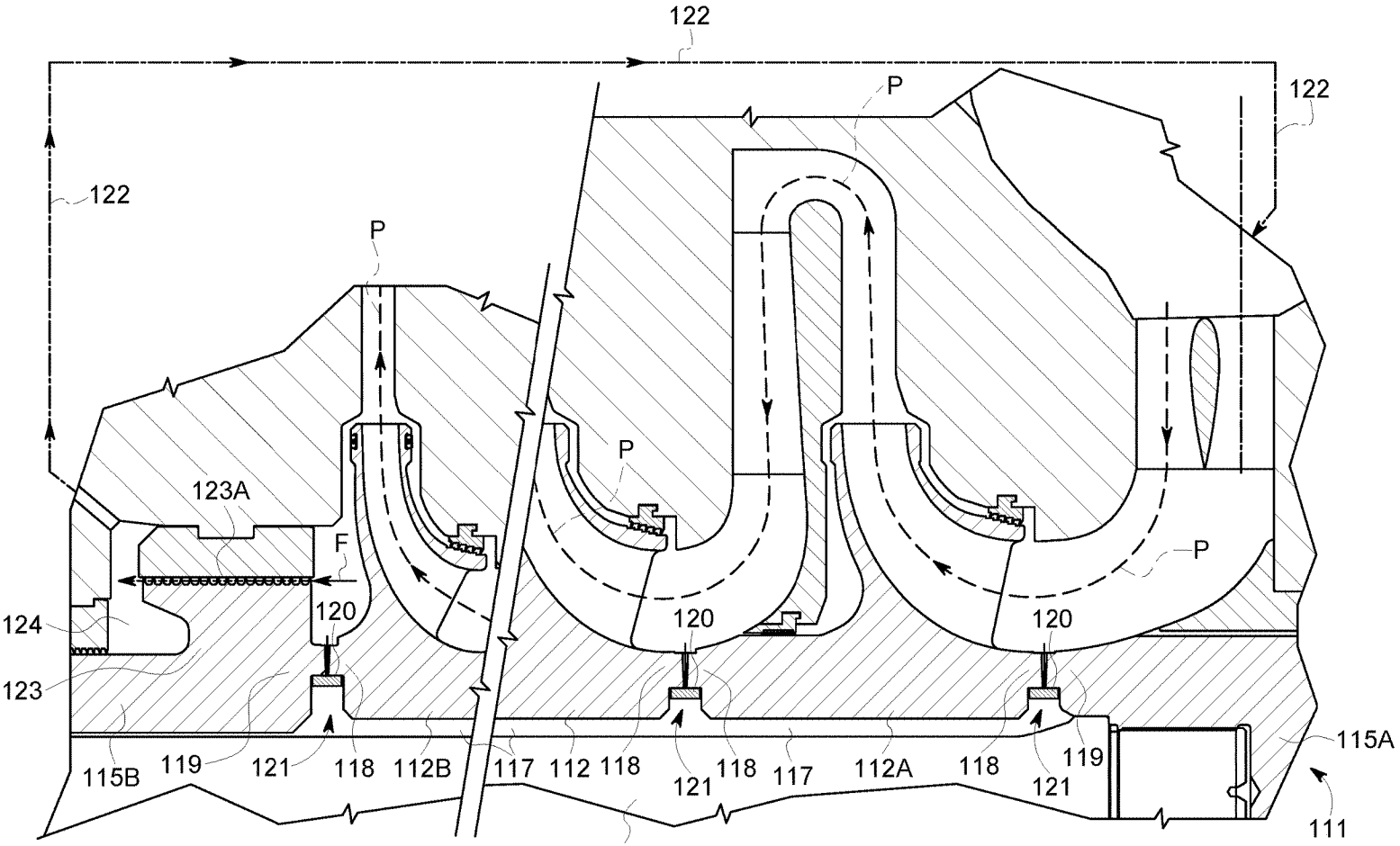
FIG. 2 illustrates an enlarged portion of FIG. 1.

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Referring to above-mentioned FIGS. 3 to 8, reference number 10 indicates a multi-stage compressor as a whole. The multi-stage compressor comprises an inlet 10A, an outlet 10B, a rotor 11 with a plurality of stacked impellers 12, and a stationary housing 13 housing the rotor 11.

The stationary housing comprises a plurality of diaphragms 13A wherein each impeller 12 discharges the gas flow to convert the kinetic energy of the gas flow into pressure recovery before returning the gas flow to the next impeller. Each impeller/diaphragm combination is called "stage". The first stage of the compressor comprises the first impeller 12A, and the last stage of the compressor comprises the last impeller 12B. The terms "first" and "last" as used herein are referred to the direction of flow of the gas processed by the compressor. Therefore, the first stage and the first impeller are those nearest to the compressor inlet, i.e. the most upstream ones, while the last stage and last impeller are those nearest to the compressor outlet, i.e. the most downstream ones. The diaphragms 13A and the rotor 11 are housed in a casing 13B. The terms upstream and downstream are referred to the direction of flow of the gas processed through the compressor.

In the compressor 10, a gas compression path P (indicated by a dashed line) extends from the compressor inlet 10A to the compressor outlet 10B and through said plurality of impellers 12 and the diaphragms 13A. The compression path P is sealed with respect the casing, diaphragms and rotor, using suitable seals, e.g. dry gas seals S. Other kind of seals, commonly used in the art, can be used as well.

The impellers 12 are stacked and held together by a tie rod 14. The tie rod 14 extends axially through the impellers. The rotor 11 comprises also two terminal elements: a most upstream, first terminal elements 15A provided at the end of the plurality of impellers close to the first impeller 12A; and a most downstream, second terminal elements 15B provided at the opposite end of the plurality of impellers, close to the last impeller 12B. The two ends of the tie rod 14 are constrained to the terminal elements 15A, 15B.

The hubs of the impellers 12 have through holes 16 wherein the tie rod is made to pass. The holes 16 are dimensioned so as to leave an interspace or clearance 17 between the tie rod and the inner surface of the holes 16.

Each impeller 12 comprises two opposite contacting surfaces co-acting with the surfaces respectively of two other adjacent impellers 12, or respectively with the surface of an adjacent impeller and the surface of a terminal element 15A or 15B at one end of the plurality of stacked impellers. The contact is such that the impellers are torsionally constrained one to the other and torque is transferred between the impellers. In some embodiments, each impeller 12 comprises two opposite toothed flanges 18 meshing with respective toothed flanges of two other adjacent impellers 12 or, in the case the impeller is the first 12A or the last 12B impeller of the stack, respectively with toothed flange 18 of an adjacent impeller 12 and the toothed flange 19A or 19B of a terminal element 15A or 15B. The toothed flanges form Hirth couplings or connections. Other kinds of connections known to those skilled in the art can be used instead of a Hirth-type coupling.

To avoid gas leakage from the compression path P to the interspace or clearance 17, seals 20 are provided on the meshing areas 21, where of the teeth of respective adjacent intermediate impellers 12 co-act.

The compressor comprises a balancing line 22 (indicated by a dash-dot line) for balancing the axial thrust of the impellers on the rotor bearings. More in particular, the compressor comprises a balancing drum 23 (formed on the terminal element 15B) delimiting a balancing zone 24 from a zone in fluid communication with the outlet of the last impeller 12B. The balancing zone 24 is fluidly connected via the balancing line 22 with the inlet of the first impeller 12A, so that the pressure in the balancing zone 24 is substantially equal to the pressure of the inlet of the first impeller 12A.

The balancing drum 23 is arranged in a cylindrical housing in the casing 13B. Between the housing and the balancing drum 23 a labyrinth seal 23A is provided, so that a calibrate gas flow leakage from the outlet of the last impeller 12B towards the balancing zone 24 is allowed. The pressure difference between a first face 23' of the balancing drum 23 facing the last impeller, and a second opposite face 23" facing the balancing zone 24, generates an axial thrust on the balancing drum 23. The axial thrust on the balancing drum 23 counterbalances the axial thrust exerted by the impellers. In this embodiment the balancing line 22 is formed by a pipeline external to the compressor casing.

The interspace or clearance 17 forms a flow channel between the tie rod 14 and the stacked impellers 12. The flow channel (also labeled 17) is in fluid communication with a first location PA and a second location PB along the gas compression path P. The first location PA is at a lower pressure than the second location PB. The pressure difference between the first location PA and the second location PB generates a gas flow along the flow channel 17, as better explain below.

According to some embodiments, the first location PA is provided at the inlet of the first compressor stage where the first impeller 12A is located, and the second location PB is provided at the outlet of the last compressor stage, where the last impeller 12B is located. This provides for the maximum pressure difference between the first location PA and the second location PB.

The fluid connection between the first location PA and the flow channel 17 as well as between the flow channel 17 and the second location PB is established by respective passages.

Figure 3:
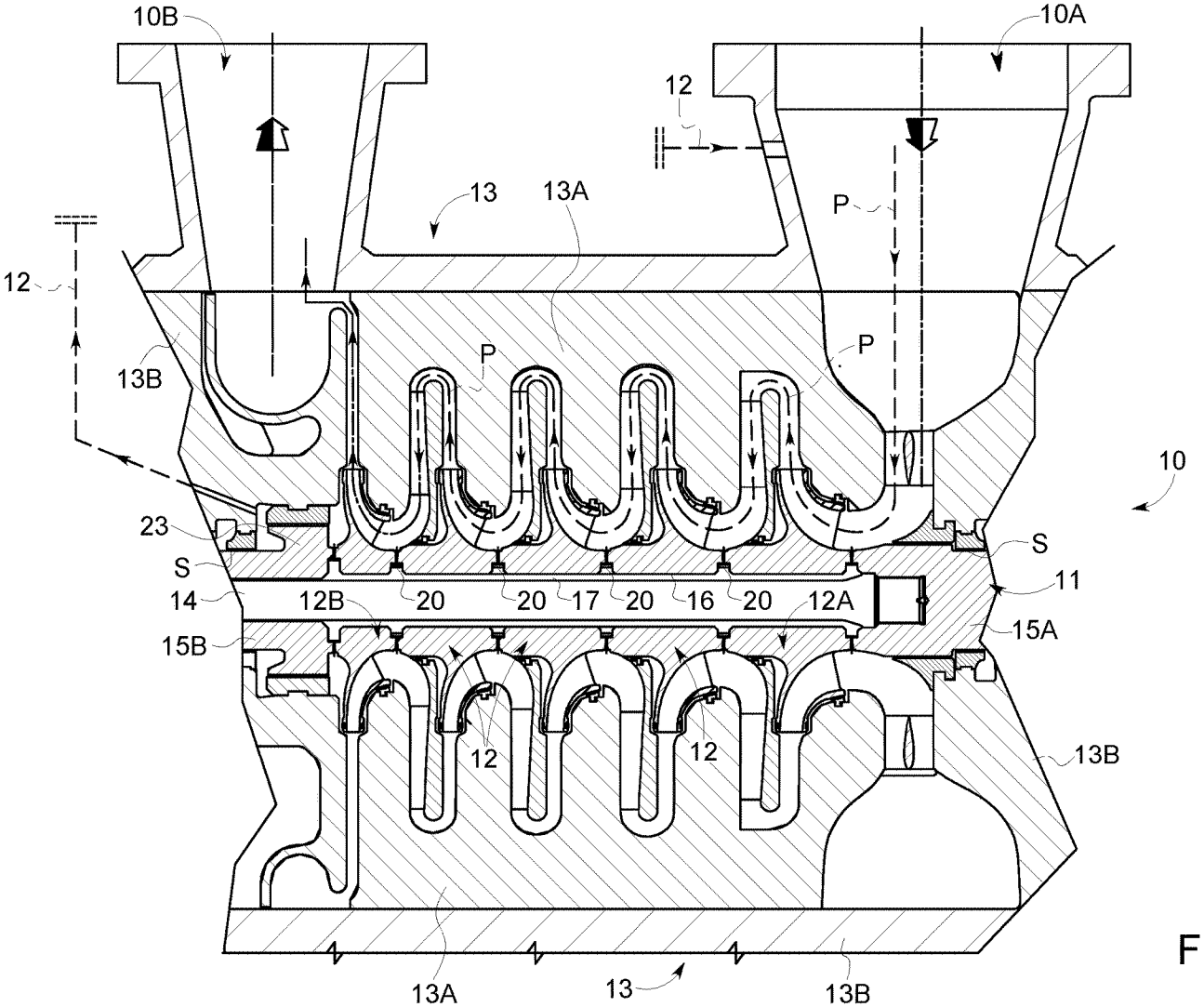
FIG. 3 illustrates an axial-sectional view of the main part of a multi-stage compressor according to one embodiment of the present disclosure.
Figure 4:
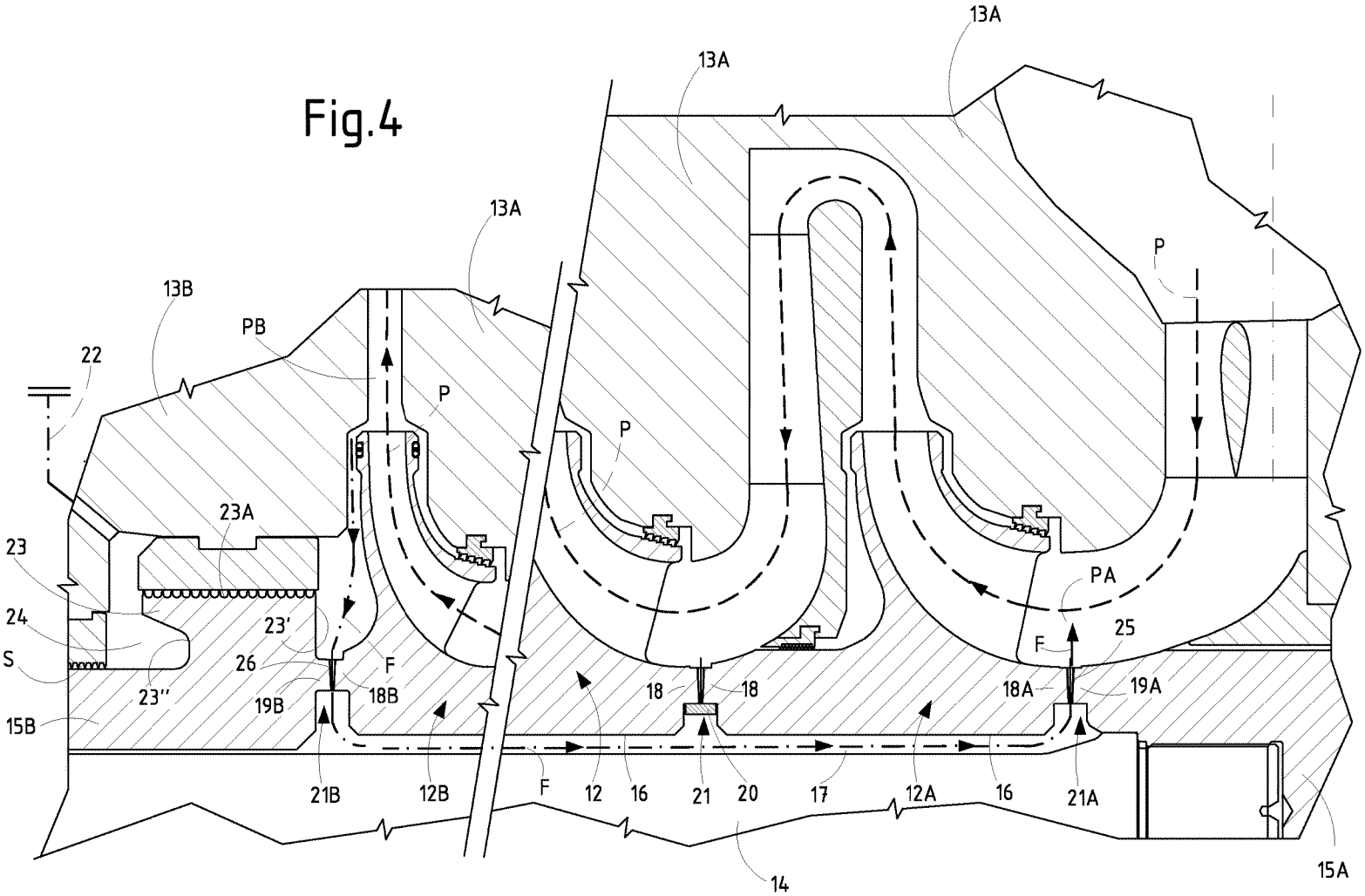
FIG. 4 illustrates an enlarged portion of FIG. 3.

In the embodiment of FIGS. 3 and 4, the meshing area 21A, where the toothed flange 18A of the first impeller 12A meshes with the toothed flange 19A of the first terminal element 15A, is at least partly lacking of the seal 20, such that at least a first gas passage 25 is established, between the first location PA and the flow channel 17, through the co-acting teeth of the toothed flanges 18A, 19A.

Figure 5:
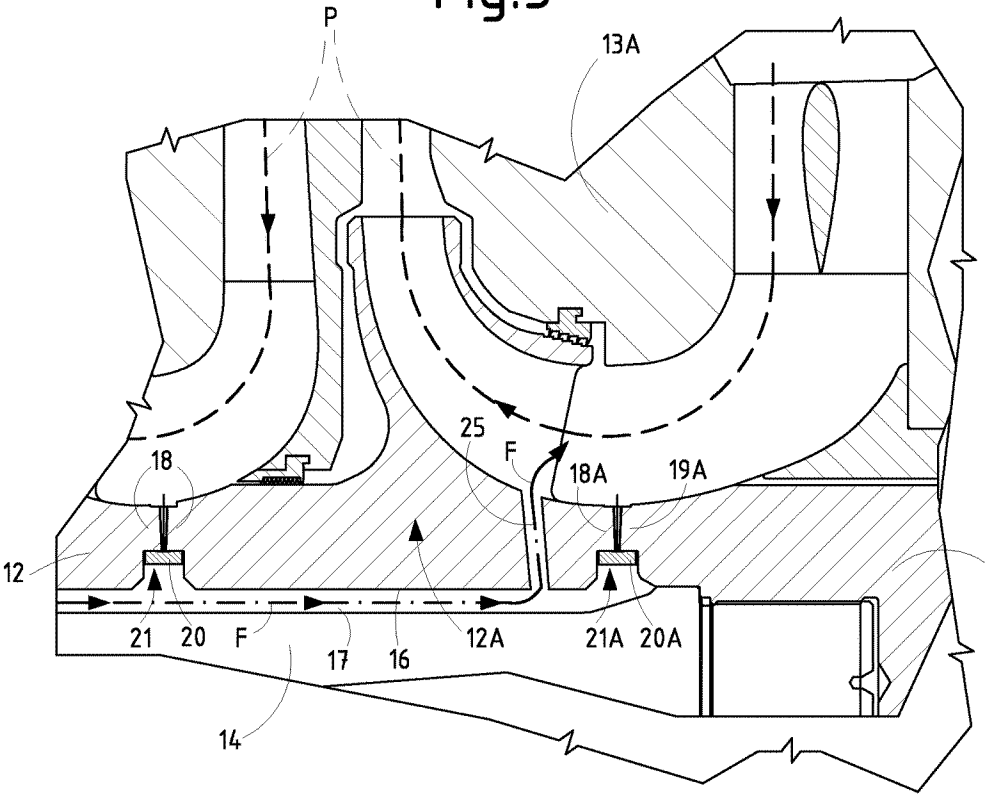
FIG. 5 illustrates a portion of a first variant of the embodiment shown in FIG. 3.

FIG. 5 illustrates a modified embodiment. The same reference numbers indicate the same or corresponding components or elements, which will not be described again in detail. The first passage, again labeled 25, which fluidly connects the first location PA of the compression path P is provided through the body or hub of the first impeller 12A. A seal 20A sealing the meshing area 21A, is provided.

Figure 6:
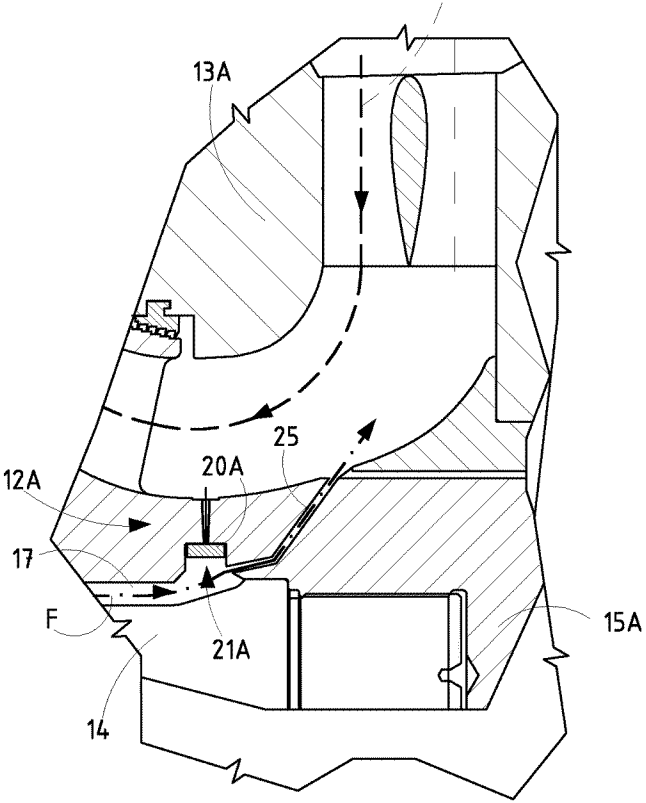
FIG. 6 illustrates a portion of a second variant of the embodiment shown in FIG. 3.

In FIG. 6 a further modified embodiment provides for a first passage 25 arranged through the body of first terminal element 15A. A seal 20A sealing the meshing area 21A, is provided. In other embodiments, the first passage can be provided in other positions and through other bodies or components of the rotor.

In the embodiment of FIGS. 3 and 4, the meshing area 21B, wherein the toothed flange 18B of the last impeller 12B meshes with the toothed flange 19B of the second terminal element 15B, is at least partly lacking of the seal 20, so that at least a second gas passage 26 is established between the second location PB and the flow channel 17, through the teeth of the toothed flanges 18B and 19B.

Figure 7:
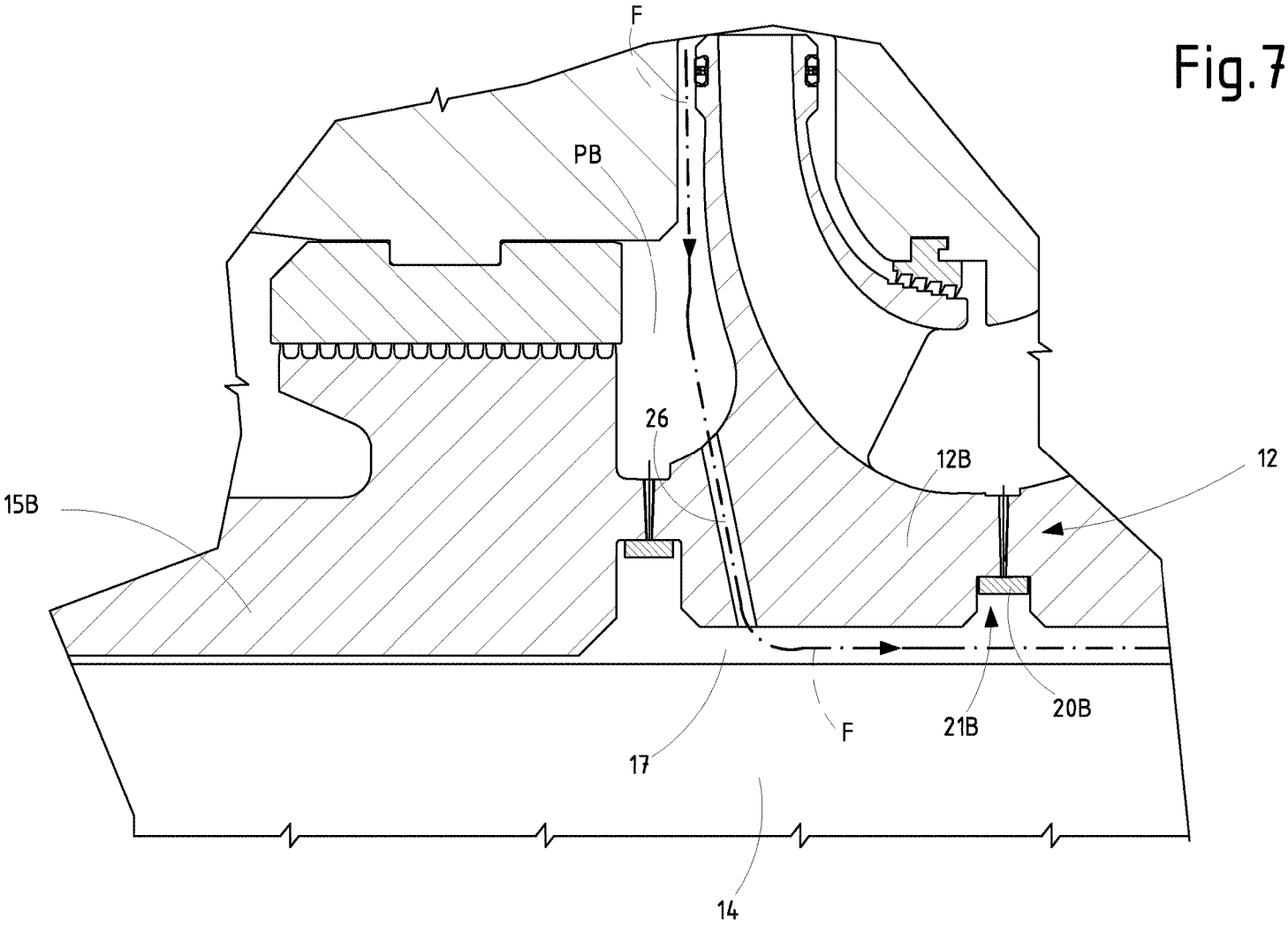
FIG. 7 illustrates a portion of a third variant of the embodiment shown in FIG. 3.

In FIG. 7, a modified embodiment provides for a second passage 26 arranged through the body or hub of the last impeller 12B. A seal 20B sealing the meshing area 21B, is provided.

In further embodiments, not shown, the second passage 26 can be provided through the body of the second terminal element 15B, similarly to the case of the first passage 25 of FIG. 6.

In yet further embodiments, the second passage 26 can be provide in other positions and through other bodies or components of the rotor.

At compressor startup the rotor 11 with tie rod 14 and impellers 12 start rotating. Gas enters through the compressor inlet 10A and flows along the compression path P through the sequentially arranged impellers 12A, 12, 12 . . . 12B and finally exits the compressor outlet 10B. At the outlet of the last impeller 12B, in the second location PB, the gas has reached the maximum pressure and temperature values, while at the inlet of the first impeller 12A, i.e. in the first location PA, the gas has the lowest temperature and pressure values. The pressure difference between the first and the last stage generates a hot gas flow F (indicated by a dashed-double dotted line) from the second location PB, through the second passage 26 in the flow channel 17 and, from the flow channel 17 to the first location PA, via the first passage 25.

The hot gas flowing along the flow channel 17 heats the tie rod 14 (before the startup, the tie rod is usually at room-temperature). Therefore, in this transient phase, the temperature gradients between the tie rod 14 and the impellers 12A, 12, 12 . . . 12B decrease.

To maximize the heating effect, as described here above, the hot gas is drawn from the last stage and is reintroduced in the gas compression path at the first stage. In other embodiments the locations PA and PB can be arranged in different positions along the compression path.

Figure 8:
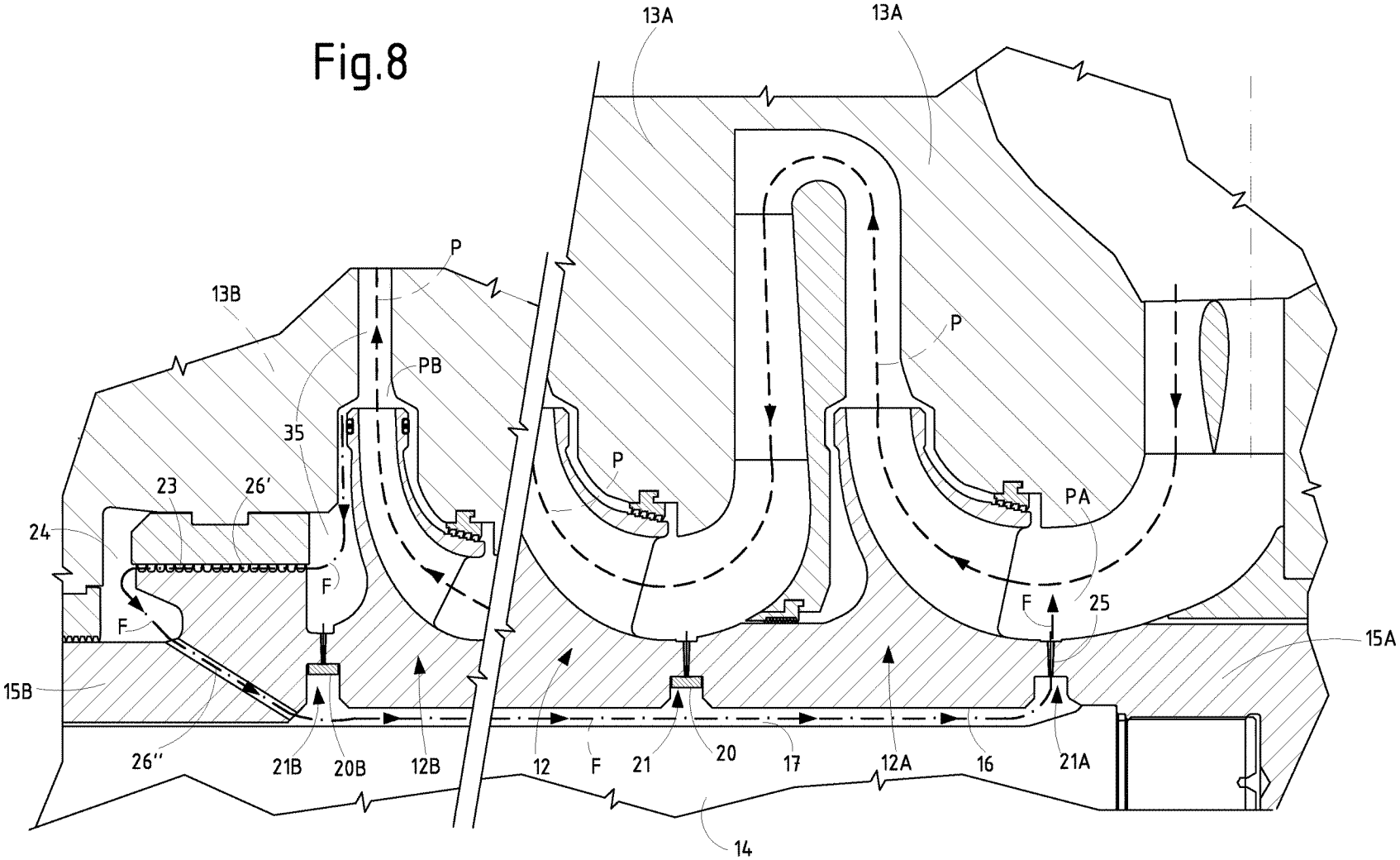
FIG. 8 illustrates a portion of a fourth variant of the embodiment shown in FIG. 3.

In FIG. 8, another embodiment is illustrated. In this case, the balancing line used to balance the axial thrust of the impellers is provided by the flow channel 17 and the external duct is removed. A pathway 26' fluidly connects the balancing zone 24 of the balancing drum 23 to the second location PB of the compression path, arranged at the outlet of the last impeller 12B. The pathway 26' is formed, e.g. by the labyrinth seal 23A, so that a calibrate gas flow leakage from the outlet of the last impeller 12B towards the balancing zone 24 is generated.

Through a second passage 26" provided in the second terminal element 15B, the balancing zone 24 is fluidly connected with the flow channel 17. Therefore, a gas flow F flows from the second location PB to the balancing zone 24, with a pressure drop, and from the balancing zone 24, via the second passage 26" to the flow channel 17. In practice, the fluid communication passage between the second location PB and the flow channel 17 is formed by the pathway 26', the balancing zone 24 and the second passage 26". From the flow channel 17, the gas flows towards the first location PA at the first compressor stage, through the first passage 25, e.g. formed in the meshing area 21A, between the teeth of the flange 18A of the impeller 12A and the teeth of the flange 19A of the first terminal element 15A (no seal is provided in the meshing area 21A).

The gas flow along the tie rod 14 heats the tie rod 14, reducing the thermal gradients between the impellers and the tie rod during startup. At the same time, the gas flow acts as a balancing flow, balancing the thrust of the impellers on the rotor bearings. This result is achieved using the interspace or clearance 17 between the impellers 12A, 12, 12, . . . 12B and the tie rod 14 as a flow channel connecting the first and last stage of the compressor.

The present disclosure concerns also a method for operating a multi-stage compressor, comprising a compressor rotor 11 with a plurality of axially stacked impellers 12 held together by a tie rod 14, and a flow channel 17 extending along the tie rod 14. The method comprises the step of heating the tie rod 14 by flowing a hot gas F along the flow channel 17 through the impellers 12 and along said tie rod 14, across at least two different stages. More specifically, in some embodiments the method comprises diverting a fraction of at least partly compressed gas processed by the compressor from a high pressure location of the gas compression path, through the flow channel 17 towards a low-pressure location of the compression path.

In some embodiments, the compressed gas used for heating the tie rod 14 flows from the outlet of the last impeller 12B, to the inlet of the first impeller 12A.

From the last stage the heating gas flows in the flow channel 17 passing between the last impeller 12B and the second terminal element 15B (FIGS. 3 and 4), or passing through the hub or body of the last impeller 12B or of the second terminal element 15B (FIG. 7 or 8).

From the flow channel 17, the heating gas flows in the first stage passing between the first impeller 12A and the first terminal element 15A (FIGS. 3 and 4), or passing through the hub or body of the first impeller 12A or of the first terminal element 15A (FIG. 5 or 6).

In case the stages in fluid communication with the flow channel are different from the first and last stages, the heating gas can flow passing through two adjacent impellers 12 or through the hub/body of impellers.

The method provides also for a balance of the thrust of the impellers against the bearings of the rotor. The gas is made to pass from the outlet of the last impeller 12B to the balancing zone 24 defined on the balancing drum in a position opposite to said last stage impeller with respect of the drum 23, and from said balancing zone 24 to the inlet of the first impeller 12A, passing on and along the tie rod 14, through said impellers, in such a way that the pressure in said inlet is substantially equal to the pressure of said balancing zone of the balancing drum.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A multi-stage gas compressor comprising:

a rotor comprising a plurality of axially stacked impellers;

a tie rod extending through the plurality of axially stacked impellers and holding the plurality of axially stacked impellers together;

a gas compression path extending from a compressor inlet to a compressor outlet and through the plurality of axially stacked impellers;

a flow channel between the tie rod and the plurality of axially stacked impellers, the flow channel developing along at least a portion of the tie rod, wherein the flow channel is in fluid communication with a first location along the gas compression path and a second location along the gas compression path, a pressure difference between the first location and the second location in the gas compression path generating a gas flow along the flow channel; and at least a first passage fluidly connecting the first location with the flow channel, and at least a second passage fluidly connecting the second location with the flow channel, wherein at least one passage of the first and second passages is provided between two toothed flanges meshing together or wherein at least one passage of the first and second passages is a duct provided through a hub of an impeller of the plurality of axially stacked impellers or through a terminal element at one end of the plurality of axially stacked impellers.

2. The multi-stage gas compressor according to claim 1, wherein the first location is provided at the compressor inlet of a first compressor stage, and the second location is provided at the compressor outlet of a last compressor stage.

3. The multi-stage gas compressor according to claim 1, wherein each impeller of the plurality of axially stacked impellers comprises two opposite contacting surfaces co-acting with respective surfaces of two adjacent impellers of the plurality of axially stacked impellers, or with a surface of an adjacent impeller and a surface of the terminal element at one end of the plurality of axially stacked impellers.

4. The multi-stage gas compressor according to claim 1, wherein at least one passage of the first and second passages is defined between contacting surfaces of two adjacent impellers, or between the contacting surfaces of the terminal element and of an adjacent impeller.

5. The multi-stage gas compressor according claim 1, wherein two adjacent impellers of the plurality of axially stacked impellers, or the impeller of the plurality of axially stacked impellers and the terminal element, contact each other by respective toothed flanges meshing together, and sealing members are arranged and configured for reducing or preventing gas leakage between at least some of the toothed flanges.

6. The multi-stage gas compressor according to claim 1, further comprising a balancing drum comprising a first face facing a most downstream impeller, and a second opposite face facing a balancing zone fluidly connected with a most upstream compressor stage.

7. The multi-stage gas compressor according to claim 6, further comprising a pathway fluidly connecting the most downstream impeller with the balancing zone of the balancing drum, wherein the pathway causes a pressure drop between the compressor outlet of the most downstream impeller and the balancing zone.

8. The multi-stage gas compressor according to claim 7, wherein at least one passage fluidly connecting the flow channel and the balancing zone is provided through the balancing drum.

9. A multi-stage gas compressor comprising:

a plurality of axially stacked impellers;

a tie rod holding the plurality of axially stacked impellers together;

a gas compression path extending from a suction side to a delivery side of the multi-stage gas compressor and through the plurality of axially stacked impellers;

a return flow path, along which a fraction of a compressed process gas flowing along the gas compression path flows back from a downstream location to an upstream location of the gas compression path, the return flow path extending along the tie rod, so that heat generated by compression in the compressed processed gas is transferred to the tie rod by forced convection; and at least a first passage fluidly connecting the upstream location with the return flow path, and at least a second passage fluidly connecting the downstream location with the return flow path, wherein at least one passage of the first and second passages is provided between two toothed flanges meshing together or wherein at least one passage of the first and second passages is a duct provided through a hub of an impeller of the plurality of axially stacked impellers or through a terminal element at one end of the plurality of stacked impellers.

10. The multi-stage gas compressor according to claim 9, wherein each impeller of the plurality of axially stacked impellers comprises two opposite contacting surfaces co-acting with respective surfaces of two adjacent impellers of the plurality of axially stacked impellers, or with a surface of an adjacent impeller and a surface of the terminal element at one end of the plurality of axially stacked impellers.

11. The multi-stage gas compressor according to claim 10, wherein at least one passage of the first and second passages is defined between contacting surfaces of two adjacent impellers, or between the contacting surfaces of the terminal element and of an adjacent impeller.

12. The multi-stage gas compressor according to claim 9, wherein at least one passage of the first and second passages is defined between contacting surfaces of two adjacent impellers of the plurality of axially stacked impellers, or between the contacting surfaces of the terminal element and of an adjacent impeller.

13. The multi-stage gas compressor according claim 9, wherein two adjacent impellers of the plurality of axially stacked impellers, or the impeller of the plurality of stacked impellers and the terminal element, contact each other by respective toothed flanges meshing together, and sealing members are arranged and configured for reducing or preventing gas leakage between at least some of the toothed flanges.

14. The multi-stage gas compressor according to claim 9, further comprising a balancing drum comprising a first face facing a most downstream impeller, and a second opposite face facing a balancing zone fluidly connected with a most upstream compressor stage.

15. The multi-stage gas compressor according to claim 14, further comprising a pathway fluidly connecting the most downstream impeller with the balancing zone of the balancing drum, wherein the pathway causes a pressure drop between a compressor outlet of the most downstream impeller and the balancing zone.

16. The multi-stage gas compressor according to claim 15, wherein at least one passage fluidly connecting the return flow path and the balancing zone is provided through the balancing drum.

17. A method for operating a multi-stage gas compressor, comprising a compressor rotor with a plurality of axially stacked impellers held together by a tie rod, and a flow channel extending along at least a portion of the tie rod, the method comprising:

heating the tie rod by flowing a hot gas along the flow channel and along the tie rod, wherein the hot gas flows from a most downstream compressor stage to a most upstream compressor stage.

18. The method according to claim 17, further comprising:

diverting a portion of the hot gas processed by the multi-stage gas compressor from a high-pressure location along a compression path extending across the multi-stage gas compressor; and flowing the portion of the hot gas along the flow channel towards a low-pressure location along the compression path.

19. The method according to claim 17, further comprising:

flowing a portion of the hot gas from the most downstream compressor stage to a balancing zone defined on a balancing drum in a position opposite the most downstream compressor stage; and flowing the portion of the hot gas from the balancing zone to an inlet of the most upstream compressor stage, passing on and along the tie rod, through the plurality of axially stacked impellers.

20. The multi-stage gas compressor according to claim 3, wherein at least one passage of the first and second passages is defined between contacting surfaces of two adjacent impellers, or between the contacting surfaces of the terminal element and of an adjacent impeller.

* * * * *